US012369720B2

(12) United States Patent
Shan et al.

(10) Patent No.: US 12,369,720 B2
(45) Date of Patent: Jul. 29, 2025

(54) BED FRAME

(71) Applicant: Keeson Technology Corporation Limited, Zhejiang (CN)

(72) Inventors: Huafeng Shan, Zhejiang (CN); Jian Wang, Zhejiang (CN); Xiang Nie, Zhejiang (CN); Shaojun Li, Zhejiang (CN)

(73) Assignee: Keeson Technology Corporation Limited, Jiaxing (CN)

( * ) Notice: Subject to any disclaimer, the term of this patent is extended or adjusted under 35 U.S.C. 154(b) by 365 days.

(21) Appl. No.: 17/791,269

(22) PCT Filed: Mar. 6, 2020

(86) PCT No.: PCT/CN2020/078179

§ 371 (c)(1),
(2) Date: Jul. 7, 2022

(87) PCT Pub. No.: WO2021/138996

PCT Pub. Date: Jul. 15, 2021

(65) Prior Publication Data

US 2023/0033589 A1 Feb. 2, 2023

(30) Foreign Application Priority Data

Jan. 10, 2020 (CN) ..... 202020048499.4

(51) Int. Cl.
*A47C 19/12* (2006.01)

(52) U.S. Cl.
CPC ..... *A47C 19/122* (2013.01)

(58) Field of Classification Search
CPC ... A47C 19/122; A47C 19/028; A47C 19/025; A47C 20/041; A47C 19/00; A47C 19/02; A47C 19/005; A47C 19/021; A47C 20/12; A47C 17/68; A47C 19/024; A47C 17/70; A47C 19/12; A47C 19/04; A47C 31/023;

(Continued)

(56) References Cited

U.S. PATENT DOCUMENTS 6,370,714 B1 * 4/2002 Elzenbeck ..... A47C 7/282 5/112
6,511,562 B1 * 1/2003 Coffield ..... A47C 4/30 156/196

(Continued)

FOREIGN PATENT DOCUMENTS

CN 201011978 Y 1/2008
CN 202588969 U * 12/2012 ..... A47C 17/86
CN 209610523 U * 11/2019

OTHER PUBLICATIONS

Office Action of Counterpart Canadian Patent Application No. 3,164,280 issued on Oct. 6, 2023.

(Continued)

*Primary Examiner* — Madison Emanski

(57) ABSTRACT

A bed frame includes: an external frame, an internal supporting portion and a bed cover. The external frame is a hollow frame. The internal supporting portion is of a large-interval structure. The internal supporting portion is arranged inside the external frame to reinforce the strength of the external frame. The bed cover covers the top faces of the external frame and the internal supporting portion to form a flat bed surface.

7 Claims, 3 Drawing Sheets

(58) Field of Classification Search
CPC ..... A47C 19/045; A47C 21/022; A47C 31/04; A47C 7/22; A47C 31/02; A47C 5/06; A47C 21/06; A47C 27/16; A47C 19/027; A47C 23/06; A47C 7/282; A47C 23/26; A61G 7/015; F16B 12/10; F16B 12/54; F16B 2012/106
USPC ..... 5/174, 617, 111, 114, 110, 112, 616, 5/236.1; 297/440.11, 452.2, 218.3
See application file for complete search history.

(56) References Cited

U.S. PATENT DOCUMENTS

2018/0110339 A1* 4/2018 Moon ..... A47C 19/122
2022/0000269 A1* 1/2022 Shan ..... A47C 20/12

OTHER PUBLICATIONS

International Search Report of PCT Patent Application No. PCT/CN2020/078179 issued on Sep. 29, 2020.

* cited by examiner

BED FRAME

FIELD OF THE INVENTION

The present utility model relates to the technical field of homes, in particular to a bed frame.

BACKGROUND OF THE INVENTION

In the American market, foundations (bed frames) are widely used in families. Each of the foundations mainly consists of an iron frame, wooden strips and bed feet, or only the iron frame, for its main purpose to support a mattress. However, the appearance is not beautiful enough, and people can see wooden slats, iron frames, etc., so the sense of value is low. Also, it needs to be assembled by the terminal user, so the user experience is poor. The material cost is high.

SUMMARY OF THE INVENTION

The present utility model provides a bed frame to solve the technical problems of the bed frame of low appearance value, terminal assembly and high material cost.

For this purpose, the present utility model provides a bed frame. The bed frame includes: an external frame, an internal supporting portion and a bed cover. The external frame is a hollow frame. The internal supporting portion is of a large-interval structure. The internal supporting portion is arranged inside the external frame to reinforce the strength of the external frame. The bed cover covers the top faces of the external frame and the internal supporting portion to form a flat bed surface.

Further, open grooves are arranged in edges of the external frame. The open grooves penetrate along the edges of the external frame to form a closed loop. Edges of the bed cover are arranged in the open grooves at the corresponding positions.

Further, foldable plastic strips are arranged at the edges of the bed cover. The bed cover is detachably arranged in the open grooves at the corresponding positions by means of the plastic strips.

Further, the bed frame further includes: an elastic supporting piece. The elastic supporting piece is arranged on the upper portion of the external frame or the internal supporting portion. The bed cover is located on the top face of the elastic supporting piece.

Further the elastic supporting piece is made of pearl wool.

Further, the external frame includes: a first external frame and a second external frame. The first external frame and the second external frame are connected in a foldable manner.

Further, the internal supporting portion is a net-shaped frame.

Further, the bed frame further includes: a plurality of bed feet. The bed feet are symmetrically arranged on the external frame to support the bed frame.

Further, the bed cover is a closable hollow cover body, and the bed cover wraps the external frame and the internal supporting portion.

Further, the bed cover is closed by means of zippers arranged on the bottom face.

The adoption of the large-interval structure design inside the bed frame in combination with the bed cover reduces the material cost and weight while ensuring the strength, and improves the appearance of the product by means of the bed cover, bringing people a high-grade sense of value, and facilitating product sales.

BRIEF DESCRIPTION OF THE DRAWINGS

By reading the detailed description of the non-restrictive embodiments with reference to the drawings below, other features, objectives and advantages of the utility model will be more apparent.

DESCRIPTION OF REFERENCE NUMERALS

1—external frame, 2—internal supporting portion; 3—bed cover, 4—net-shaped frame, 5—elastic supporting piece, 6—bed foot, 11—open groove, 12—first external frame, 13—second external frame, 31—plastic strip, 7—top face, 8—the upper portion of the external frame, 9—corresponding positions.

DETAILED DESCRIPTION OF THE EMBODIMENTS

The present utility model is further described in detail below with reference to the drawings.

Figure 1:
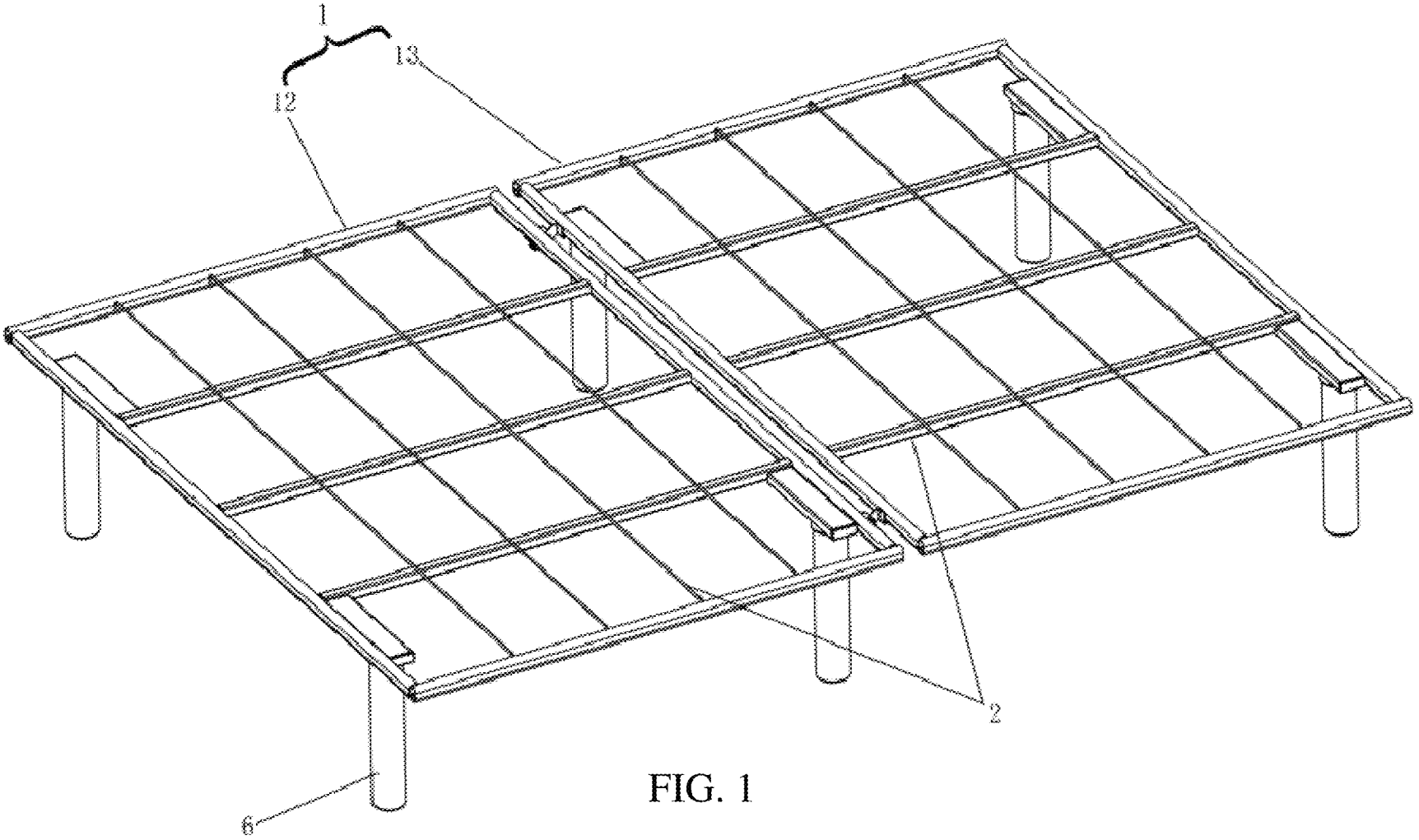
FIG. 1 is a schematic stereo-structural diagram of a bed frame of an embodiment of the utility model.
Figure 2:
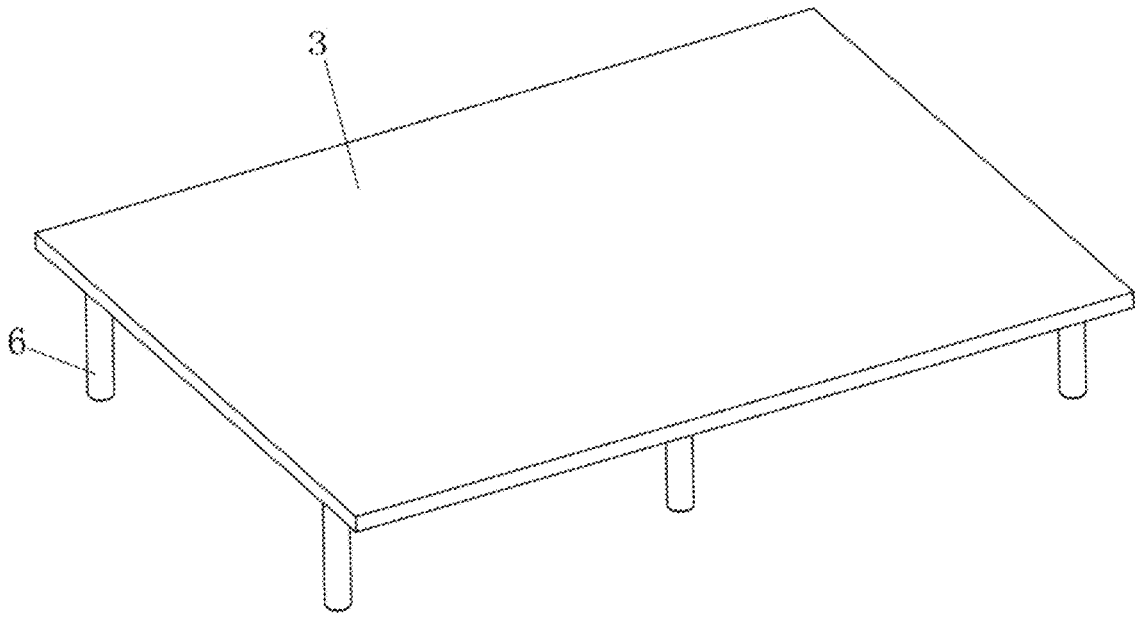
FIG. 2 is a perspective view of a bed cover of an embodiment of the utility model.
Figure 3:
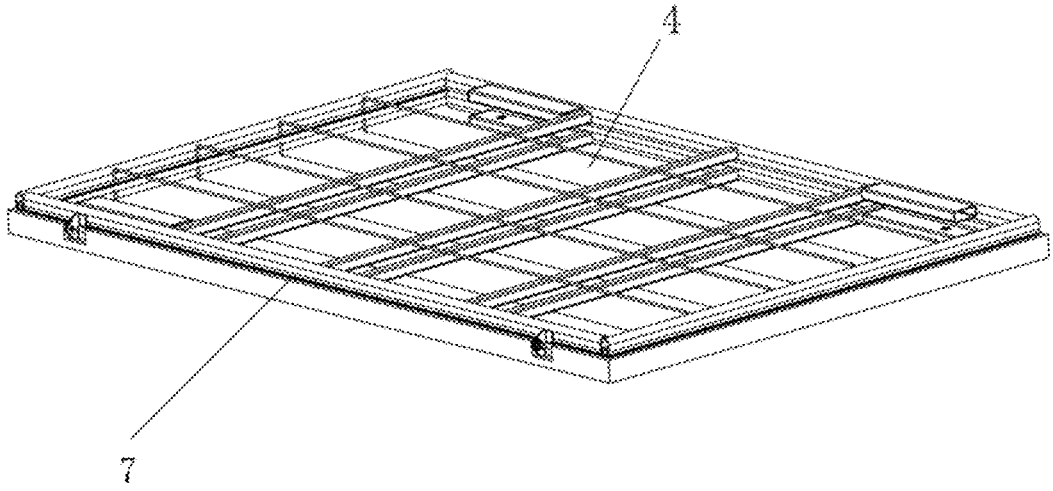
FIG. 3 is a schematic structural diagram of a bed frame in a folded state of an embodiment of the utility model.

FIG. 1 is a schematic stereo-structural diagram of a bed frame of an embodiment of the utility model, FIG. 2 being a perspective view of a bed cover of an embodiment of the utility model, FIG. 3 being a schematic structural diagram of a bed frame in a folded state of an embodiment of the utility model. As shown in FIG. 1 to FIG. 3, the bed frame provided by the utility model includes: an external frame 1, an internal supporting portion 2 and a bed cover 3. The external frame 1 is a hollow frame. The internal supporting portion 2 is of a large-interval structure. The internal supporting portion 2 is arranged inside the external frame 1 to reinforce the strength of the external frame 1. The bed cover 3 covers the top faces 7 of the external frame 1 and the internal supporting portion 2 to form a flat bed surface.

The internal supporting portion 2 supports the external frame 1 and can be made of a metal material, ensuring the strength of the bed frame and preventing the external frame 1 from deforming. The internal supporting portion 2 of a large-interval design structure, preferably of a net-shaped frame 4 structure, can reduce the raw material cost and overall weight. The external frame 1 can be selected in various shapes, such as circle, quadrilateral, oval, etc. The bed cover 3 covers the top face 7 of the bed frame, and can be made of fabrics of various materials. It is simple and easy to operate and has a very low cost. It shields the internal structure of the bed frame, bringing people a more beautiful visual experience, improving the sense of value and grade of the whole product, and being felt more comfortable.

Figure 4:
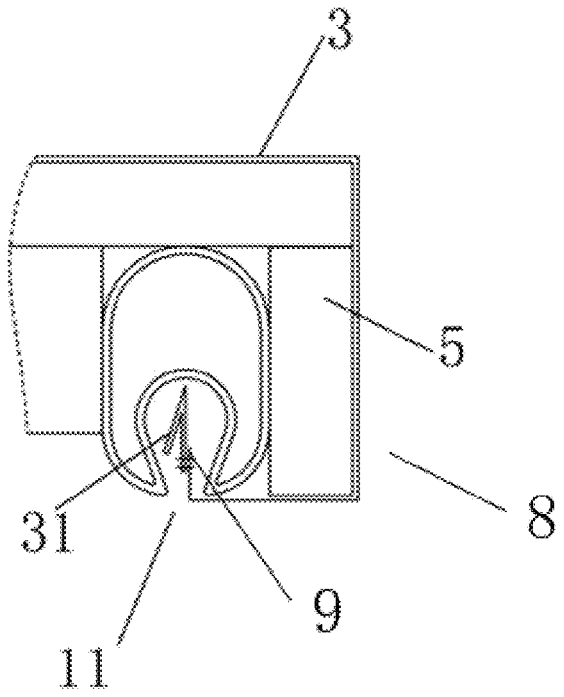
FIG. 4 is a sectional view of an external frame of an embodiment of the utility model.

Further, FIG. 4 is a sectional view of an external frame of an embodiment of the utility model. As shown in FIG. 4, open grooves 11 are arranged in edges of the external frame 1. The open grooves 11 penetrate along the edges of the external frame 1 to form a closed loop. Edges of the bed cover 3 are arranged in the open grooves 11 at the corresponding positions 9.

The purpose of arranging the open grooves 11 in the edges of the external frame 1 is to make the whole bed surface flatter and more beautiful. Open sides are arranged on the bottom faces or side faces of the external frame 1, avoiding the open grooves 11 and the edges of the bed cover 3 from being exposed, and improving the beauty of the bed frame.

Further, as shown in FIG. 4, foldable plastic strips 31 are arranged at the edges of the bed cover 3. The bed cover 3 is detachably arranged in the open grooves 11 at the corresponding positions 9 by means of the plastic strips 31.

By placing the foldable plastic strips 31 in the open grooves 11 to fix the bed cover 3, the folded plastic strips 31 form barbs sticking in the open grooves 11. The bed cover 3 is not prone to falling off from the open grooves 11, but it is easy to mount and demount, which is simple and convenient.

Further, as shown in FIG. 4, the bed frame further includes: an elastic supporting piece 5. The elastic supporting piece 5 is arranged on the upper portion of the external frame 8 or the internal supporting portion 2. The bed cover 3 is located on the top face 7 of the elastic supporting piece 5.

The elastic supporting piece 5 wraps the whole top face 7 and side faces to separate the external frame 1 and the internal supporting portion 2 from the bed cover 3. The elastic supporting piece 5 can also tighten the bed cover 3 to make the appearance of the bed cover plumper and more beautiful, and can also play the role of elastically supporting a mattress, avoiding damage to the mattress, and making it more comfortable.

Preferably, the elastic supporting piece 5 is made of pearl wool. EPE pearl wool has good softness and cushioning, light weight and low price, and thus is suitable for large-scale production.

Further, as shown in FIG. 1, the external frame 1 includes: a first external frame 12 and a second external frame 13. The first external frame 12 and the second external frame 13 are connected in a foldable manner.

The external frame 1 can be fixed into two portions, i.e., the first external frame 12 and the second external frame 13, both of which have the same structure, and the two are hinged to realize the folding of the bed frame, which reduces the packaging volume and facilitates transportation. When in use, the folded bed frame only needs to be unfolded, which eliminates the complicated mounting process and saves costs.

Further, as shown in FIG. 1 and FIG. 2, the bed frame further includes: a plurality of bed feet 6. The bed feet 6 are symmetrically arranged on the external frame 1 to support the bed frame.

The bed feet 6 can adjust the height of the bed frame, which only needs to form open holes in the corresponding positions 9 without the complicated process.

Further, as shown in FIG. 2, the bed cover 3 is a closable hollow cover body, and the bed cover 3 wraps the external frame 1 and the internal supporting portion 2.

The outer side surfaces of the whole bed frame are wrapped with the bed cover 3 to form a tightened bed surface. The bed cover 3 is tightened by means of detachable methods such as zippers. The inside of the closed bed cover 3 can be compounded with sponge, polyester cotton, non-adhesive cotton, etc. to increase comfort, and it makes the appearance plumper. The tightened fabric can help support the mattress, preventing the elastic supporting piece 5 from deforming due to extrusion of the mattress, which improves the overall beauty.

After considering the specification and practicing the utility model disclosed herein, those skilled in the art will easily think of other implementations of the utility model. The present application is intended to cover any variations, objectives or adaptive changes of the utility model, and these variations, objectives or adaptive changes follow the general principles of the utility model and include common general knowledge or conventional technical means in the technical field that are not disclosed in the present disclosure. The specification and embodiments are considered exemplary only, and the true scope and spirit of the utility model are indicated by the following claims.

It should be appreciated that the present utility model is not limited to the precise structure that having been described above and shown in the drawings and can make various modifications and changes without departing its scope.

The invention claimed is:

1. A bed frame, characterized in that the bed frame comprises: an external frame, an internal supporting portion and a bed cover;

wherein the external frame is a hollow frame;

the internal supporting portion is arranged in the external frame to reinforce strength of the external frame;

the bed cover is configured to covers top faces of the external frame and the internal supporting portion to form a flat bed surface;

the bed frame further comprises: an elastic supporting piece;

wherein the elastic supporting piece is arranged on an upper portion of the external frame or on the internal supporting portion, the bed cover being located on a top face of the elastic supporting piece;

open grooves are arranged in edges of the external frame;

the open grooves penetrate along the edges of the external frame to from a closed loop;

edges of the bed cover are arranged in the open grooves at corresponding positions.

2. The bed frame according to claim 1, characterized in that foldable plastic strips are arranged on the edges of the bed cover;

the bed cover is detachably arranged in the open grooves at the corresponding positions by means of the plastic strips.

3. The bed frame according to claim 1, characterized in that the elastic supporting piece is made of pearl wool.

4. The bed frame according to claim 1, characterized in that the external frame comprises: a first external frame and a second external frame, the first external frame and the second external frame being connected in a foldable manner.

5. The bed frame according to claim 1, characterized in that the internal supporting portion is a net-shaped frame.

6. The bed frame according to claim 1, characterized in that the bed frame further comprises: a plurality of bed feet, the bed feet being symmetrically arranged on the external frame to support the bed frame.

7. The bed frame according to claim 1, characterized in that the bed cover wraps the external frame and the internal supporting portion.

* * * * *